US006345801B1

(12) United States Patent
Boulet

(10) Patent No.: US 6,345,801 B1
(45) Date of Patent: Feb. 12, 2002

(54) MOULD FOR MOLTEN MAGNESIUM AND METHOD OF PRODUCING MAGNESIUM INGOTS

(76) Inventor: Alain Renaud Boulet, 230 York St., Strathroy, Ontario (CA), N7G 2E5

( * ) Notice: Subject to any disclaimer, the term of this patent is extended or adjusted under 35 U.S.C. 154(b) by 0 days.

(21) Appl. No.: 09/334,179

(22) Filed: Jun. 16, 1999

Related U.S. Application Data

(60) Provisional application No. 60/089,618, filed on Jun. 16, 1998.

(51) Int. Cl.[7] ..... B22D 5/04; B22D 9/00

(52) U.S. Cl. ..... 249/79; 249/111; 249/139; 249/160; 249/174; 249/204; 164/330; 164/348; 164/443; 164/DIG. 6

(58) Field of Search ..... 249/79, 80, 111, 249/137, 139, 160, 174, 204; 164/329, 330, 348, 418, 443, DIG. 6

(56) References Cited

U.S. PATENT DOCUMENTS 728,552 A * 5/1903 Dixon ..... 249/168
1,665,275 A * 4/1928 Perry ..... 249/168
1,892,044 A * 12/1932 Eldred et al. ..... 164/126
3,705,616 A * 12/1972 Tenner ..... 164/155
3,954,447 A * 5/1976 Souchon ..... 75/67 R
4,287,936 A * 9/1981 Ljublinsky et al. ..... 164/329
4,465,117 A * 8/1984 Mason ..... 164/137

FOREIGN PATENT DOCUMENTS

FR 2481967 * 11/1981

* cited by examiner

*Primary Examiner*—Nam Nguyen
*Assistant Examiner*—Donald Heckenberg
(74) *Attorney, Agent, or Firm*—Hahn Loeser & Parks LLP; Stephen L. Grant

(57) ABSTRACT

This invention relates to an improved mould for casting a standard Magnesium ingot. The mould is constructed so as to minimize the surface area of the molten Magnesium which is exposed to the surrounding air. This significantly reduces the reliance on costly or harmful gases typically used in the casting process. The vertical mould which is internally tapered, has an open top and a closure at the bottom thereof. The ingot is easily removed from the mould when said closure is opened. The mould is adapted for use as part of an automated process employing a cyclic conveyance system for efficiently producing Magnesium ingots from recycled scrap Magnesium.

5 Claims, 4 Drawing Sheets

FIG.3
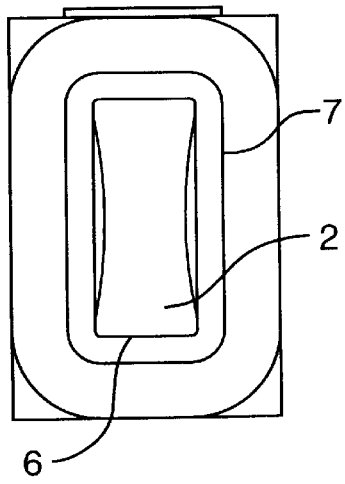
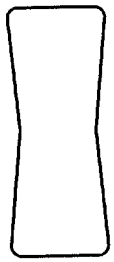
FIG.4A
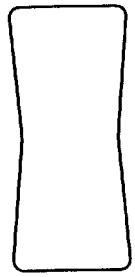
FIG.4B
FIG.5
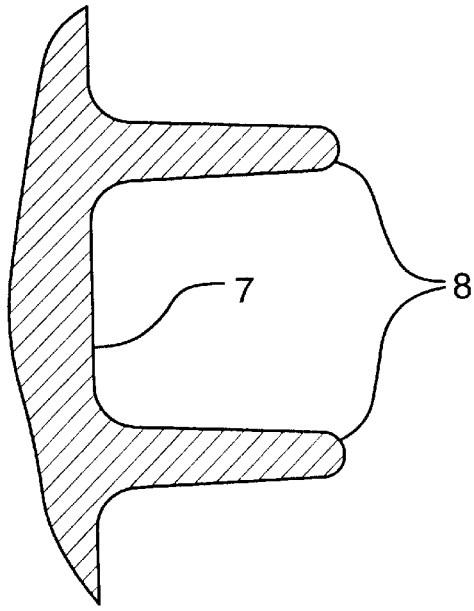

MOULD FOR MOLTEN MAGNESIUM AND METHOD OF PRODUCING MAGNESIUM INGOTS

This patent application is a continuation of and claims priority from U.S. Provisional Patent Application No. 60/089,618 filed on Jun. 16, 1998.

BACKGROUND OF THE INVENTION

This invention relates to a mould for casting a standard Magnesium ingot. Further, this invention relates to an automated method of casting standard Magnesium ingots using the mould of the present invention.

It is known to cast ingots using moulds into which molten metal is poured. In the case of Magnesium, a standard 25 or 26 pound ingot is made by typically using a trough type mould having an open top which is approximately 28" long×6.5" wide×2.5" deep. The term "standard" relates both to the size and weight of the ingot and ultimately depends on the type of equipment used to cast magnesium parts. It can be seen that this mould exposes a surface area of approximately 182 sq. inches of the molten metal to the surrounding air. In the case of Magnesium this is important since the molten metal reacts with air causing it to burn at the exposed surface.

In order to prevent burning, an oxidizing agent such as $SO_2$ (sulphur dioxide) or $SF_6$ (sulphur hexaflouride) is used to create an oxide layer at the exposed surface area of the molten metal. The oxide layer of surface skin thereby formed prevents the molten Magnesium from reacting with air and burning. The disadvantage of using these gases relates to cost, and the environmental hazards and health risks they pose. While there is nothing wrong with the prior art moulds in terms of the Magnesium ingot produced, the drawback lies with the requirement and need to use large quantities of these environmentally toxic gases.

BRIEF SUMMARY OF THE INVENTION

It is an object of the present invention to provide a mould for casting a better quality Magnesium ingot which significantly reduces the need to use oxidizing agents or masking gases such as Argon.

It is a further object of the invention to automate the casting of Magnesium ingots which method is greatly facilitated by the use of a mould made in accordance with this invention.

These objects are achieved by providing a vertical Magnesium mould for casting a standard ingot comprising an internally tapered chamber having an open top and a closure at the bottom thereof. The mould accordingly has a small opening at its top to minimize the surface area of the molten Magnesium in the mould chamber which is exposed to air.

Furthermore, the mould of the present invention is preferably built with cooling fins around its periphery to better dissipate the heat from the molten metal and thus achieve more rapid cooling of the Magnesium in the mould. As well, the mould walls which define the chamber are tapered downwardly and outwardly to facilitate the removal of the Magnesium ingot.

Yet further, the cross-section of the mould chamber may be varied to permit various handling or stacking strategies for the ingot, as for example; circular, substantially rectangular, or 'bow tie'cross-sections as described elsewhere in this specification.

The mould of the present invention may be used as part of a process to recycle Magnesium scrap into ingots. The mould lends itself to automation, and is adapted for inclusion as part of an automated system for efficiently producing Magnesium ingots. According to this method, a plurality of moulds each having suitable attachment means are attached to the belt of a conveyance system at uniform distances. The belt of the conveyance system forms a complete loop such that each mould during one full cycle is successively carried to various automated stations involved in the production of the ingot including; evaporation chamber, pouring chamber, cooling chamber, and ingot station where the finished ingot is mechanically removed.

BRIEF DESCRIPTION OF THE DRAWINGS

In the accompanying drawings which form part of the specification and are to be read in conjunction therewith and in which like reference numerals are used to indicate like parts in various views.

FIG. 3 is a top view of the mould, accentuating the bow tie shape of the chamber walls.

FIG. 4A is a top view of a resulting Magnesium ingot.

FIG. 4B is a bottom view of a resulting Magnesium ingot.

FIG. 5 is an enlarged view of a transverse section of two cooling fins.

PREFERRED EMBODIMENT

Figure 1:
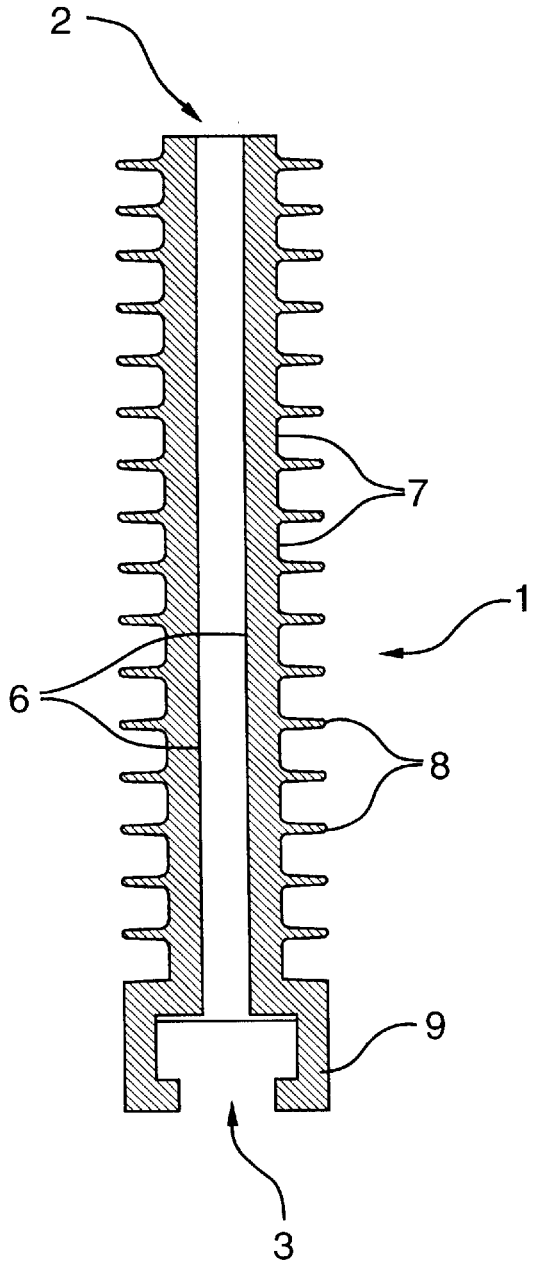
FIG. 1 is a sagittal section of an individual mould.
Figure 2:
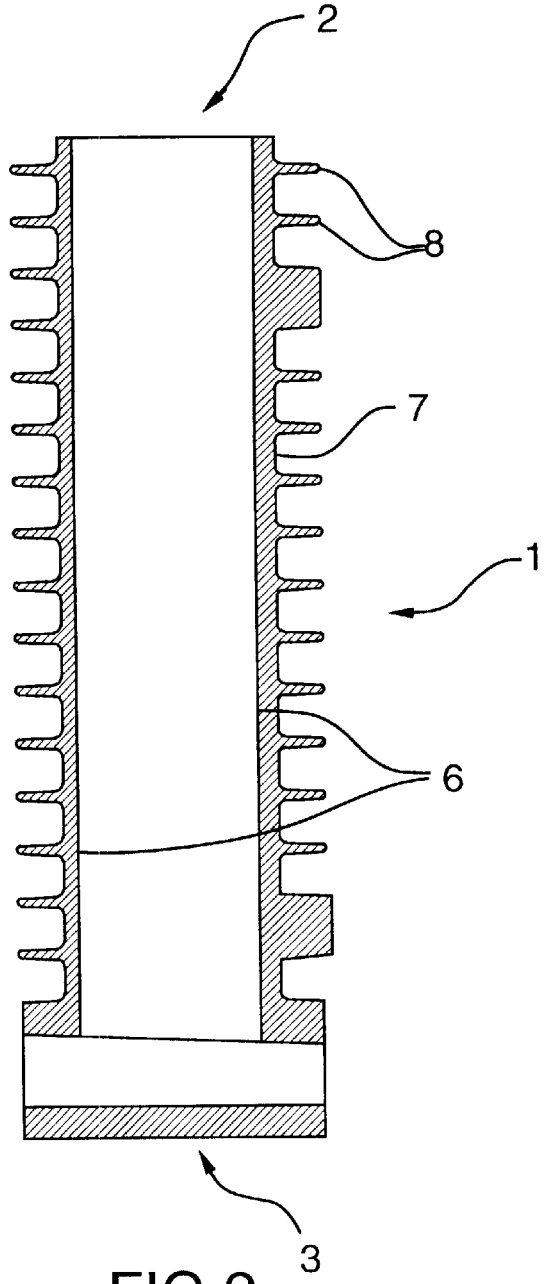
FIG. 2 is a transverse section of an individual mould.

Turning now to the drawings in greater detail and initially to FIGS. 1 and 2, the vertical Magnesium mould 1 made according to the present invention is shown. In operation the mould 1 is vertically orientated in an up and down direction and the top 2 of the mould is accordingly shown at FIGS. 1 and 2. The walls of the mould are made from iron cast in a conventional way and are approximately one inch thick.

Figure 6:
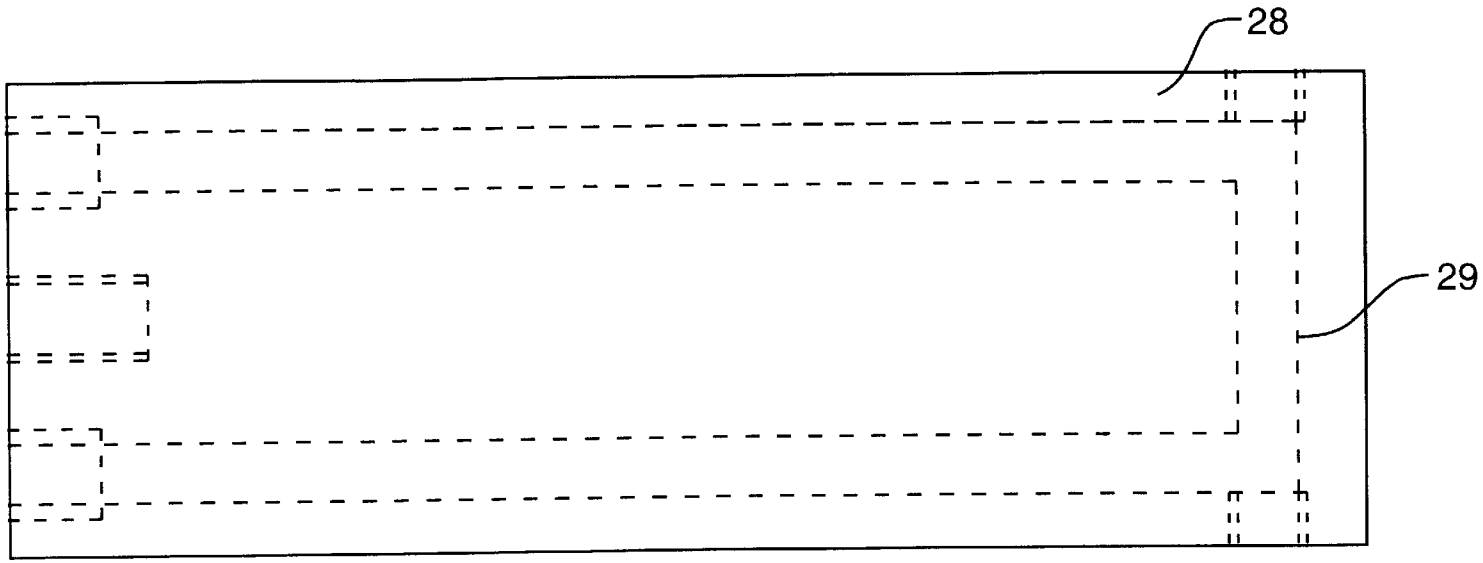
FIG. 6 is a top view of a wedge.
Figure 7:
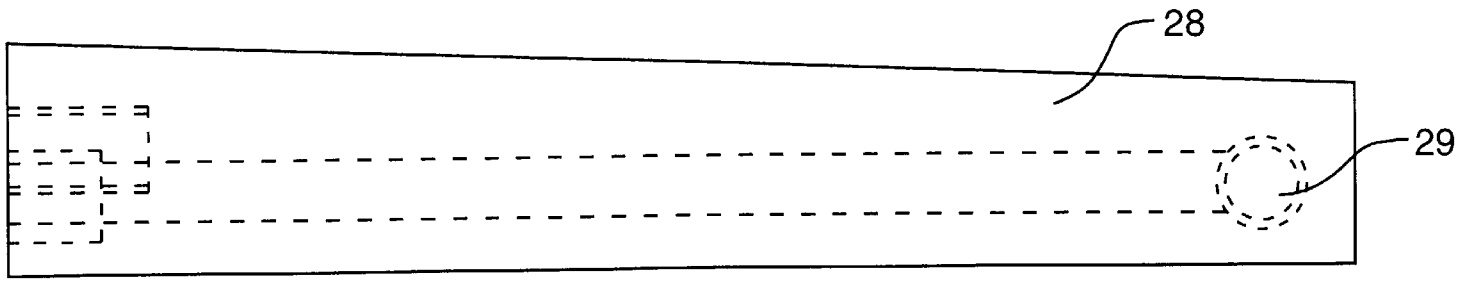
FIG. 7 is a side view of a wedge.

In the particular embodiment shown the mould I has a small open top 2 presenting a minimum surface area to the surrounding air. As well, cooling fins 8 are located on the exterior surface 7 and arrayed in a conventional way to obtain more rapid cooling of the molten metal within the mould chamber. An enlarged view of two cooling fins is shown in FIG. 5. Returning to FIG. 1, the bottom 3 of the mould is adapted to receive a tapered wedge 28 shown at FIGS. 6 and 7. The bottom 3 of the mould is adapted to receive the wedge 28 in the form of a C shaped cross-section 9 into which the wedge is mechanically forced sealing the bottom opening of the mould against the top surface of the wedge and acting as a closure. The C shaped cross-section is accordingly open at either end to accommodate and provide for the securement of the wedge and equally permit its removal by means of striking the wedge preferably with a pneumatic or hydraulic cylinder 24, or alternatively with a mallet or the like, in a direction opposite to the taper. For purposes of using this mould in an automated process described elsewhere in this specification, cooling means may be provided for the wedge such as a water-jacket or channels 29 integrally formed within as shown at FIGS. 6 and 7 through which water may be pumped.

The mould is dimensioned to produce a standard ingot weighing approximately 25 or 26 pounds. The term "standard" ultimately depends on the particular equipment to be used to manufacture Magnesium parts. It should be appreciated that particular manufacturing operations using Magnesium ingots may require the use of an ingot having a weight different than 25 or 26 pounds as for example, 15 pounds. In that case, the term standard shall also refer to the 15 pound ingot and the casting thereof using the mould of the present invention having a small open top. Naturally, other variations are permitted without departing from the spirit of the invention. The key dimensions are those which minimize the area of the open top of the mould chamber. Preferably the exposed surface area is kept less than 20 sq. inches. In the case of the mould shown the surface area is approximately 13 sq. inches.

Referring again to the minimal surface area presented by the mould described herein by way of preferred embodiment, an area reduction of at least 14 times over a typical prior art mould is achieved. This, in turn, results in a corresponding reduction in the amount of oxidizing agent or masking gas required.

It can be seen that the mould 1 can have any suitable cross-section. Referring to FIG. 3 it can be seen that the interior surface 6 of the mould 1 has a "bow tie" cross-section. This has the advantage of permitting the cast ingots to be horizontally stacked.

Figure 8:
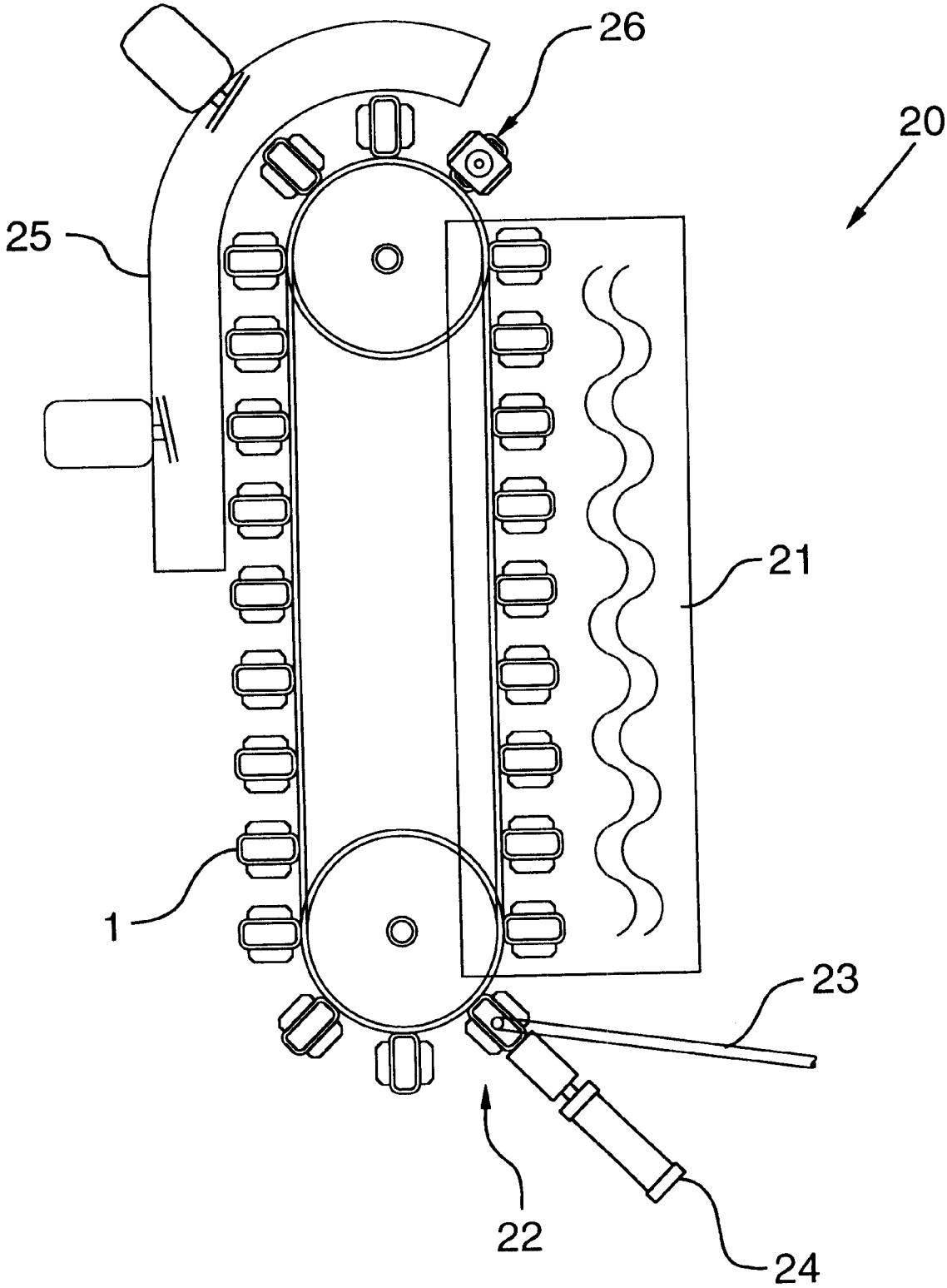
FIG. 8 is a top view of the conveyance system for producing Magnesium ingots.

The mould is well adapted to be used as part of an automated system to efficiently produce Magnesium ingots as shown in FIG. 8. Each mould is adapted with suitable attachment means for attachment to the belt of the conveyance system and distributed uniformly thereon. The moulds move simultaneously and are carried in succession to the various stations involved in the production of the ingots.

The following is a description of the path of an individual mould as it travels a full cycle of the conveyance system. The starting position of the mould has been arbitrarily chosen. First, the empty mold 1 passes through an evaporation chamber 21 where any moisture is removed. The mould then reaches the filling station, where a wedge 28 is inserted into the C shaped 9 receiving means at the base of the mould preferably using a pneumatic or hydraulic cylinder 24. Once the wedge sealing the base of the mould is in position, molten Magnesium is poured into the top of the mold via a pour tube 23. The Magnesium at the bottom of the mold is actively cooled by the cooling means 29 integrally formed within the wedge 28 causing the Magnesium at the lower region of the mould chamber to solidify. After solidification of this region has occurred the wedge is then mechanically removed, preferably by a hydraulic or pneumatic cylinder 24. The mould then continues onwards through a cooling chamber where the remaining molten Magnesium in the cavity cools and solidifies. When the mold reaches the ingot station, the Magnesium ingot is preferably removed by a hydraulic or pneumatic cylinder which is oriented above the mould so as to push downwards on the ingot knocking it out through the bottom of the aperture of the mould. The mould is then carried to the evaporation chamber 21 where the cycle described is repeated.

The oxidizing agent or masking gas, if any, is preferably introduced and used at the filling station 22 immediately after the mould has been filled (not shown in FIG. 8).

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A vertical mold for casting a standard magnesium ingot comprising a vertically elongated and tapered chamber having a uniform cross section, an open top for receiving the molten metal and a closure at the bottom thereof operable to close and retain the molten metal within the chamber and to open to permit the removal of said ingot through said bottom of the mold, said open top having an area of less than 20 $in^2$ and of more than 8 $in^2$, wherein said closure comprises a wedge and wherein said bottom of the mold receives said wedge in sealing engagement with reference to the chamber and wherein said wedge is cooled by means of cooling channels.

2. The invention as claimed in claim 1 wherein said uniform cross section is a bow tie.

3. The invention as claimed in claim 2 wherein said mold has cooling fins circumferentially arranged thereon.

4. The invention as claimed in claim 3 wherein said tapered chamber is tapered downwardly and outwardly along its vertical length.

5. The invention as claimed in claim 1 wherein the mold has means for attachment to a conveyor.

* * * * *